US008132519B2

(12) United States Patent
Behnke

(10) Patent No.: US 8,132,519 B2
(45) Date of Patent: Mar. 13, 2012

(54) INTERLOCKING, INTERCHANGEABLE SUPPORT BASE SYSTEM

(75) Inventor: Aaron A. Behnke, Menomonee Falls, WI (US)

(73) Assignee: L&P Property Management Company, South Gate, CA (US)

( * ) Notice: Subject to any disclaimer, the term of this patent is extended or adjusted under 35 U.S.C. 154(b) by 0 days.

(21) Appl. No.: 13/026,956

(22) Filed: Feb. 14, 2011

(65) Prior Publication Data

US 2011/0198459 A1 Aug. 18, 2011

Related U.S. Application Data

(63) Continuation of application No. 11/566,581, filed on Dec. 4, 2006, now Pat. No. 7,886,674.

(60) Provisional application No. 60/742,459, filed on Dec. 5, 2005.

(51) Int. Cl.
*A47B 13/02* (2006.01)

(52) U.S. Cl. ..... 108/150; 108/153.1; 248/188.6

(58) Field of Classification Search ..... 108/150, 108/153.1, 156, 158.12, 180; 248/188, 188.7, 248/165, 163.1, 188.1, 158, 159, 245; 297/463.1, 297/440.24, 445.1; 403/253, 381, 334, 187, 403/331

See application file for complete search history.

(56) References Cited

U.S. PATENT DOCUMENTS 1,604,144 A * 10/1926 Bump ..... 248/188.7
2,514,109 A * 7/1950 Walsh ..... 248/158
3,151,830 A * 10/1964 Giacomini ..... 248/188.7
3,153,524 A * 10/1964 Greenfield et al. ..... 248/158
3,250,584 A * 5/1966 Tassell ..... 312/247
3,347,509 A 10/1967 Holz et al.
3,499,625 A * 3/1970 Froedge ..... 248/188.7
3,738,287 A * 6/1973 Gusdorf et al. ..... 108/150
3,801,054 A * 4/1974 Glowacki ..... 248/188.7
3,877,669 A * 4/1975 Ambasz ..... 248/188.7
3,968,617 A * 7/1976 Hodge ..... 52/586.2
4,117,784 A * 10/1978 Piretti ..... 108/150
4,163,537 A * 8/1979 Mourgue ..... 248/188.1
4,178,858 A * 12/1979 Ponzellini ..... 108/150
4,448,378 A * 5/1984 Binfare ..... 248/188.7
4,511,108 A * 4/1985 Ponzellini ..... 248/188.7
4,562,986 A * 1/1986 Frascaroli et al. ..... 248/188.1
4,763,866 A * 8/1988 Sinchok ..... 248/188.7
4,821,986 A * 4/1989 White ..... 248/188.7
4,911,391 A * 3/1990 Ellis ..... 248/188.7
5,174,532 A * 12/1992 Huang ..... 248/188.1
5,288,045 A * 2/1994 Edwards et al. ..... 248/188.7
5,291,708 A * 3/1994 Johnson ..... 52/282.2
5,673,892 A * 10/1997 Kjellman ..... 248/188.7
5,715,760 A * 2/1998 Frascaroli et al. ..... 108/50.02
5,899,423 A * 5/1999 Albertini ..... 248/188.8
6,202,367 B1 * 3/2001 Marino et al. ..... 52/102
6,308,922 B1 * 10/2001 Hollington et al. ..... 248/188.5

(Continued)

*Primary Examiner* — Jose V Chen
(74) *Attorney, Agent, or Firm* — Conley Rose, P.C.; Kristin Jordan Harkins

(57) ABSTRACT

A support system comprises a hub comprising a channel, a leg comprising a finger that slideably engages the channel, and a washer that prevents the finger from disengaging the channel, wherein a multi-dimensional force is exerted that tightens the connection therebetween when the hub, the leg, and the washer are connected together. A method of connecting a support system for an article of furniture comprises inserting a finger of a leg into a channel of a hub to form a mating connection therebetween, connecting a washer to the hub to maintain the finger within the channel, and exerting a multi-dimensional force to secure the leg to the hub.

18 Claims, 11 Drawing Sheets

U.S. PATENT DOCUMENTS 6,367,749 B2 * 4/2002 Valiulis ..... 248/188
6,450,107 B1 * 9/2002 Sanz Novales ..... 108/153.1
2001/0019095 A1 9/2001 Valiulis

* cited by examiner

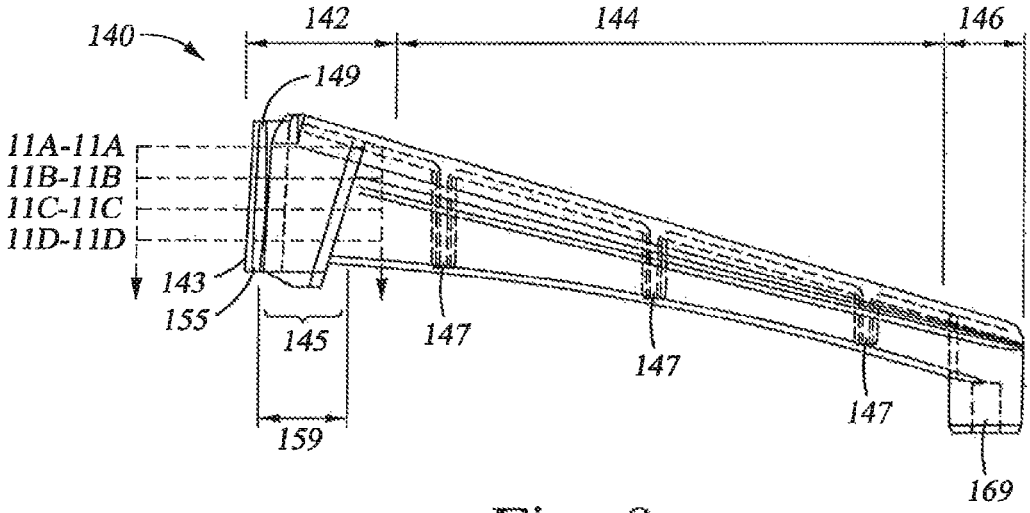
Fig. 8
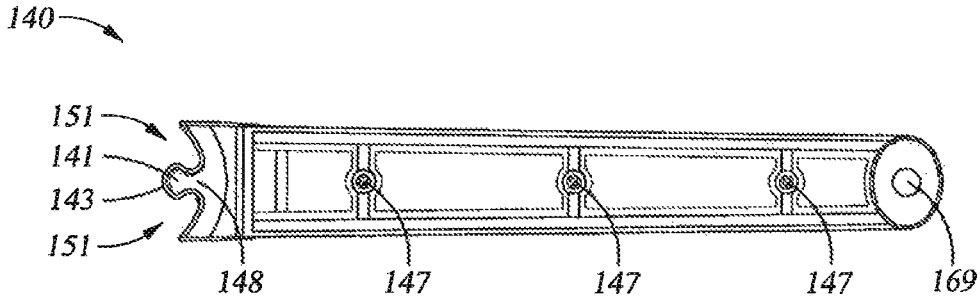
Fig. 9
Fig. 10
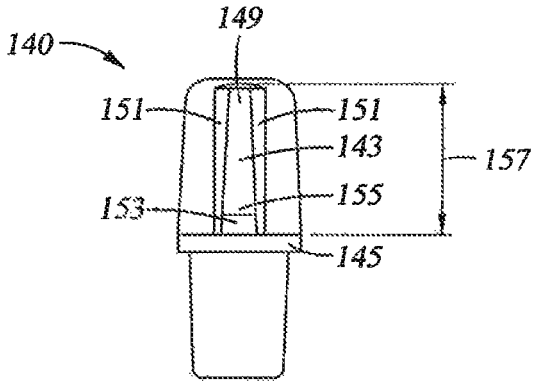

INTERLOCKING, INTERCHANGEABLE SUPPORT BASE SYSTEM

CROSS-REFERENCE TO RELATED APPLICATIONS

The present application is a continuation of and claim benefit under 35 USC §120 to co-pending U.S. patent application Ser. No. 11/566,581 entitled "Interlocking, Interchangeable Support Base System" filed Dec. 4, 2006, which in turn was related to and claims the benefit under 35 U.S.C. §119(e) of U.S. Provisional Application Ser. No. 60/742,459 filed Dec. 5, 2005 and entitled "Interlocking, Interchangeable Support Base System", all of which are assigned to the Assignee of the present application and hereby incorporated herein by reference for all purposes.

STATEMENT REGARDING FEDERALLY SPONSORED RESEARCH OR DEVELOPMENT

Not applicable.

REFERENCE TO A MICROFICHE APPENDIX

Not applicable.

FIELD OF THE INVENTION

The present invention relates generally to support base systems for articles of furniture, and more specifically to support base systems that allow for furniture legs to be removably attached to an article of furniture. Thus, the furniture legs may be replaced whenever necessary or changed to a new leg design whenever desired without retooling the entire support base system.

BACKGROUND

Many articles of furniture, including tables, chairs, and desks, comprise support base systems that provide support to other components of the furniture, such as the table top, the desk top or the chair seat, for example. In some table and desk applications, the support base comprises a plurality of legs that are welded or otherwise attached to a central pole to which at least another component of the furniture is attached. To provide sufficient structural support and a positive aesthetic look, die cast aluminum may be used to manufacture the support base system. In the die casting process, a mold is created and liquid aluminum is cast into the mold, then cooled to create the desired support base. Therefore, each mold is specific to a particular article of furniture such that once the mold is created, the shape and size of the support base is fixed. To provide a different support base shape and/or size, such as for a different piece of furniture or to change a component on the same piece of furniture, then the mold must either be retooled or a new mold created to accommodate the modified shape and/or size of the support base. Therefore, a need exists for a support base system comprising easily assembled, interchangeable components such that only the components requiring a modified shape and/or size would have to be retooled or remolded.

SUMMARY

In one aspect, the present disclosure is directed to a support system comprising a hub comprising a channel, a leg comprising a finger that slideably engages the channel, and a washer that prevents the finger from disengaging the channel, wherein a multi-dimensional force is exerted that tightens the connection therebetween when the hub, the leg, and the washer are connected together. In an embodiment, the support system further comprises a key disposed between the hub and the leg, wherein the key forces the leg away from the hub. The multi-dimensional force may be exerted by the key on the leg, on the hub, or on both. In another embodiment, the leg further comprises a pocket and the washer mates with the pocket to create the multi-dimensional force. The multi-dimensional force may be exerted by the washer on the leg. In an embodiment, the hub further comprises a guide that aligns the washer with respect to the channel. In an embodiment, the finger is shaped to prevent the leg from engaging the channel in an upside-down position. The finger may be tapered such that the cross-sectional area of the top of the finger is different than the cross-sectional area of the bottom of the finger. In an embodiment, a finger taper angle creates the change in cross-sectional area of the finger. The change in cross-sectional area of the finger may be non-uniform. In an embodiment, the channel is tapered to correspond with and matingly engage the tapered finger.

In another aspect, the present disclosure is directed to an article of furniture comprising a support system. In an embodiment, the article of furniture further comprises a support pole connected to the hub at one end and a working component of the article of the furniture at another end. In various embodiments, the working component comprises a table top or a chair seat, for example.

In yet another aspect, the present disclosure is directed to a method of connecting a support system for an article of furniture comprising inserting a finger of a leg into a channel of a hub to form a mating connection therebetween, connecting a washer to the hub to maintain the finger within the channel, and exerting a multi-dimensional force to secure the leg to the hub. In one embodiment, a tapered surface of the washer mates with a corresponding tapered surface of the leg to create the multi-dimensional force. In another embodiment, the method further comprises connecting a key between the hub and the leg to create the multi-dimensional force. In an embodiment, the leg is removeably attached to the hub.

BRIEF DESCRIPTION OF THE DRAWINGS

For a more complete understanding of the present disclosure, and for further details and advantages thereof, reference is now made to the accompanying drawings, wherein:

FIG. 8 is a side elevational view of one embodiment of a table leg of the interlocking, Interchangeable Support Base System;

FIG. 9 is a top plan view of the table leg illustrated in FIG. 8;

FIG. 10 is an end elevational view of the table leg illustrated in FIG. 8;

DETAILED DESCRIPTION OF THE INVENTION

Figure 1A:
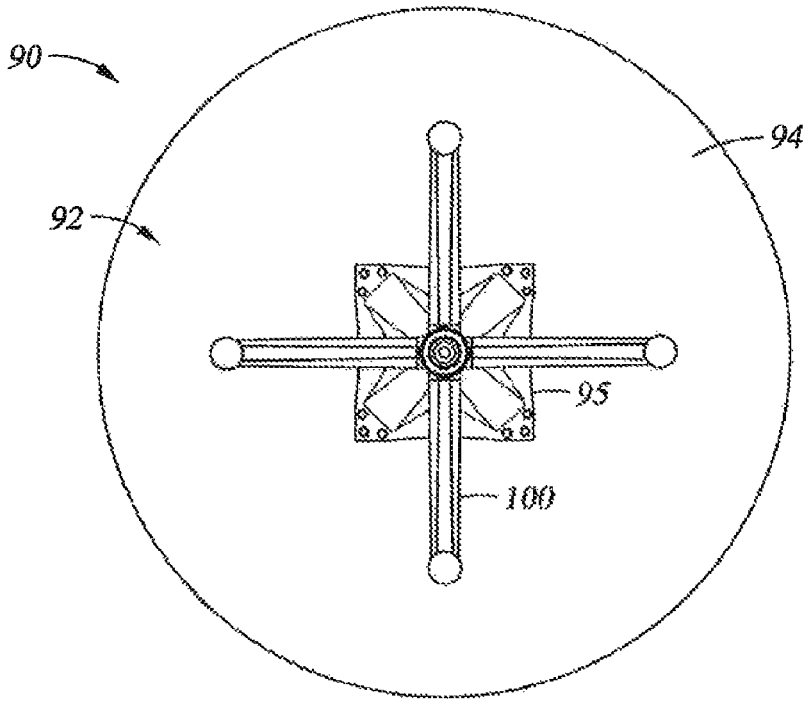
FIG. 1A is a top plan view of one embodiment of an assembled Interlocking, Interchangeable Support Base System in a representative operational environment forming part of a round table.
Figure 1B:
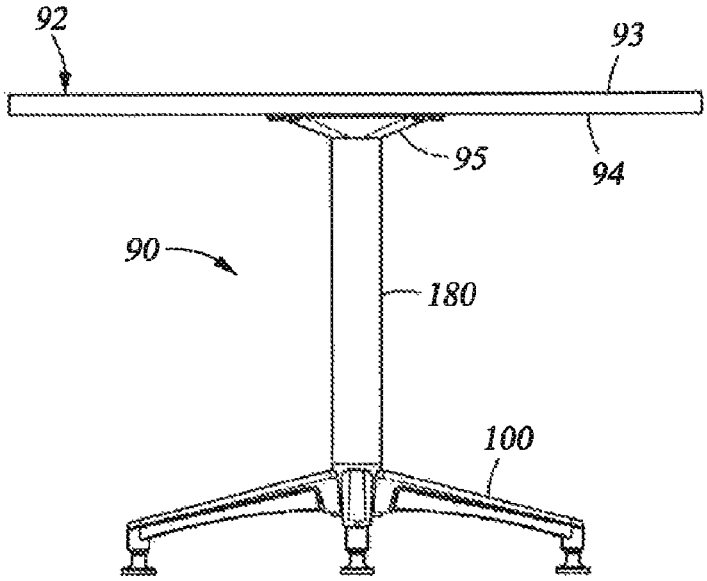
FIG. 1B is a side elevational view of the round table comprising the embodiment of the assembled Interlocking, Interchangeable Support Base System depicted in FIG. 1A.

Various embodiments of the Interlocking, Interchangeable Support Base System and methods of assembling the Interlocking, Interchangeable Support Base System will now be described with reference to the accompanying drawings, wherein like reference numerals are used for like features throughout the several views. Referring first to FIG. 1A and FIG. 1B, an article of furniture, such as a round table 90, for example, comprises a tabletop 92 comprising an upper surface 93 and a lower surface 94, a bracket 95 attached to the lower surface 94 of the tabletop 92, a support pole 180 that maintains the tabletop 92 at a desired height, and an Interlocking, Interchangeable Support Base System 100. The tabletop 92 provides the working surface for a person using the table 90. The bracket 95 connects the tabletop 92 to the support pole 180, which in turn connects to the Interlocking, Interchangeable Support Base System 100.

Figure 1C:
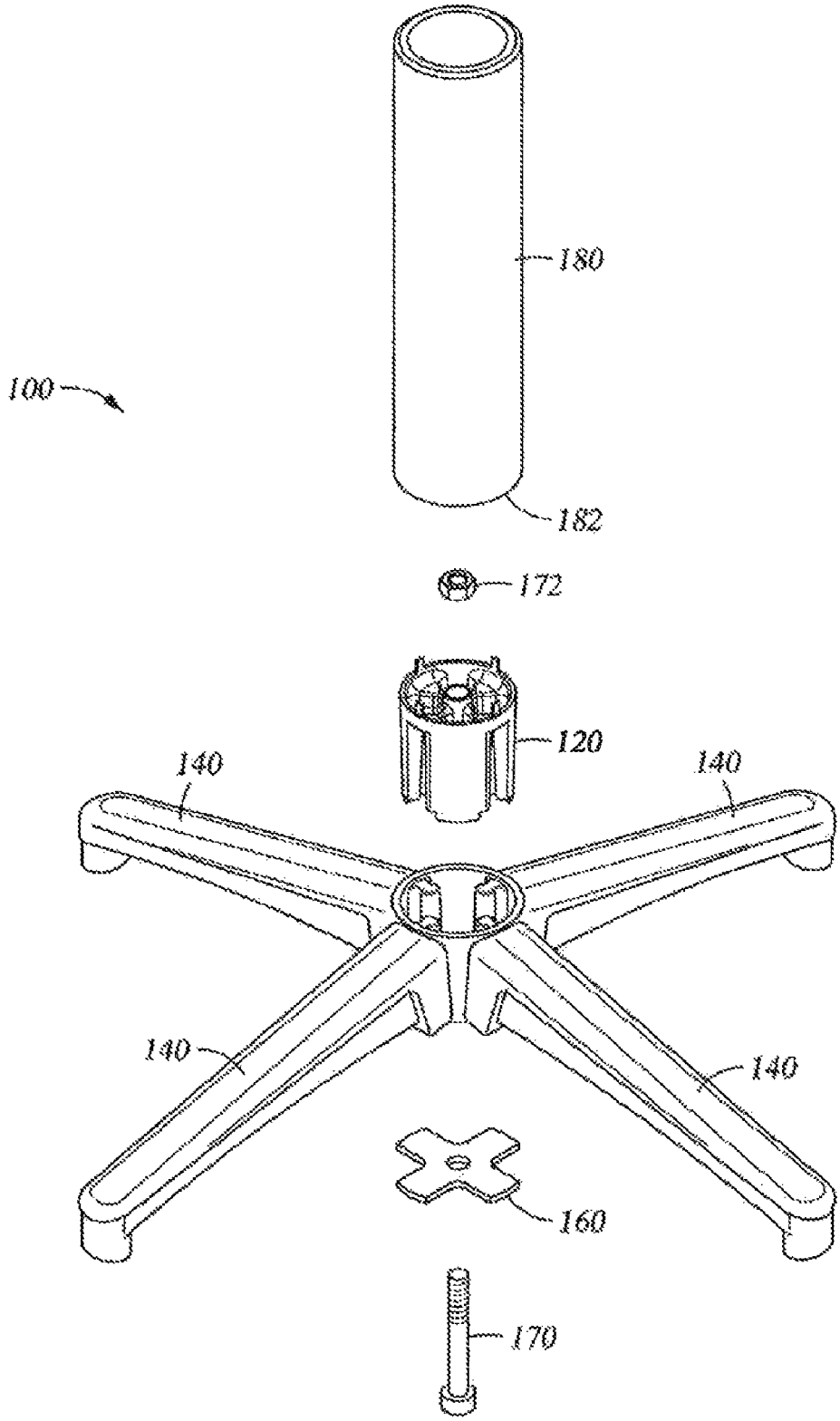
FIG. 1C is an enlarged perspective view of the various components comprising the embodiment of the Interlocking, Interchangeable Support Base System depicted in FIG. 1A.

FIG. 1C provides an enlarged perspective view of the various components comprising the Interlocking, Interchangeable Support Base System 100, namely a nut 172, a bolt 170, a hub 120, a plurality of legs 140, and a washer 160. At its lower end 182, the support pole 180 connects to the hub 120 using any one of various known attachment means, such as bolting, threading, welding, or frictional engagement. In one embodiment, the bolt 170 and the nut 172 secure the support pole 180 to the hub 120. The legs 140 are designed to removably engage the hub 120 and are held in place by the washer 160. In particular, when tightened together, the bolt 170, the washer 160, and the nut 172 secure the legs 140 in place with respect to the hub 120, thereby preventing the legs 140 from disengaging from the hub 120. Once assembled, the various components of the Interlocking, Interchangeable Support Base System 100 comprise the support base for an article of furniture, such as the round table 90.

FIGS. 2, 3, 4A and 4B illustrate a bottom plan view, a side cross-sectional view, and top and bottom perspective views, respectively, of an embodiment of the hub 120 of the Interlocking, Interchangeable Support Base System 100. The hub 120 is generally cylindrical in shape and comprises a bolt hole 122, at least one guide 124, and at least one channel 126. In the specific embodiment shown in FIGS. 2, 3, 4A, and 4B, the hub 120 comprises four guides 124 and four channels 126 arranged in an alternating configuration equidistant around the perimeter of the hub 120, as well as a centrally positioned bolt hole 122. The bolt hole 122 allows the bolt 170 to pass through the hub 120 when connecting the hub 120 to the support pole 180, for example. The guides 124 act to position the washer 160 in place when the bolt 170 is inserted through the bolt hole 122 and tightened. The channels 126 are configured to receive a corresponding finger component of the legs 140, as will be described in more detail herein, which may be inserted from the bottom of the hub 120 and then moved upwardly to slide into the channels 126. If desired, the Interlocking, Interchangeable Support Base System 100 may optionally be configured with a plurality of internal supports to increase the structural integrity of the hub 120.

Figure 3:
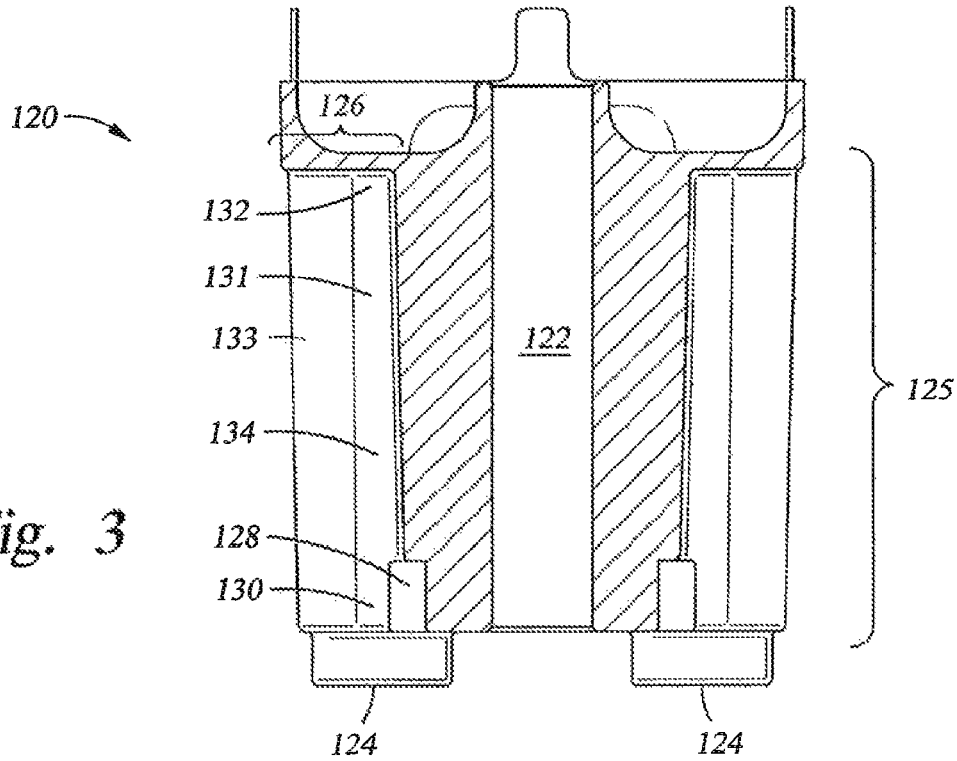
FIG. 3 is a side cross-sectional view of the hub taken along section line 3-3 of FIG. 2.
Figure 4A:
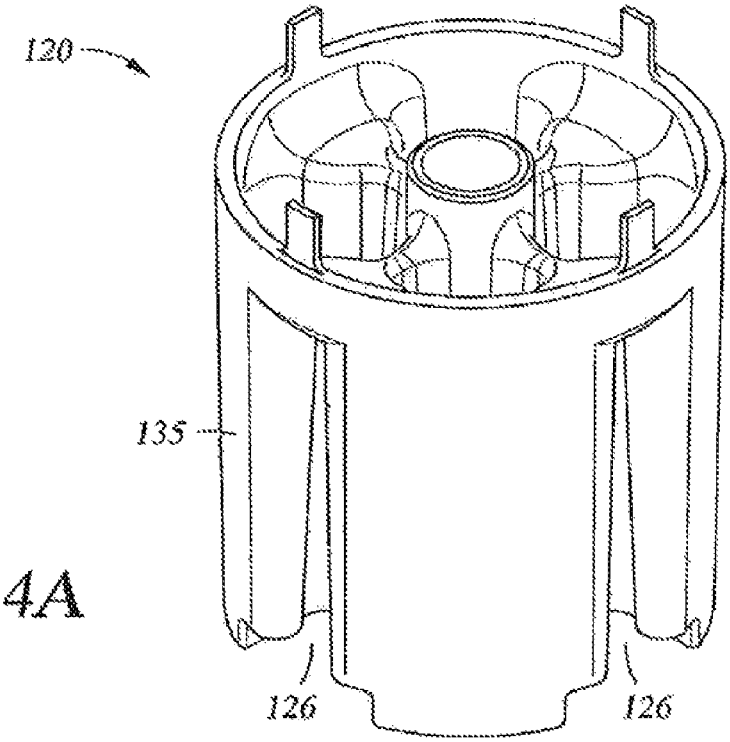
FIG. 4A is a top perspective view of the hub illustrated in FIG. 2.
Figure 4B:
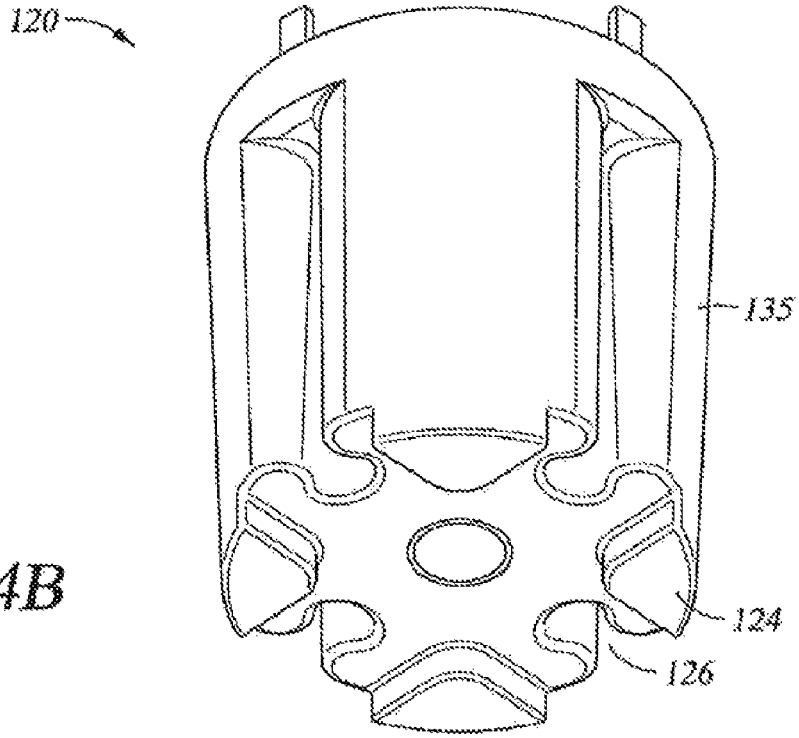
FIG. 4B is a bottom perspective view of the hub illustrated in FIG. 2.

As best shown in FIG. 3, in an embodiment, the channels 126 each comprise a cavity 134 and an optional key recess 128. The cavity 134 has a substantially vertical axis and may be outwardly tapered from top to bottom over its vertical length 125 such that the cross-sectional area of the upper portion 132 of the cavity 134 is smaller than the cross-sectional area of the lower portion 130 of the cavity 134. While it is envisioned that the change in cross-sectional area may not be uniform over the vertical length 125 of the cavity 134, in an embodiment, the change in cross-sectional area results from a cavity taper angle that produces a uniform change in cross-sectional area across the vertical length 125 of the cavity 134. The cavity taper angle may be defined as the angle between a true vertical axis and the interior wall of the cavity 134. Numerous cavity taper angles are suitable for the purposes described herein, and the specific cavity taper angle should be selected by a person of ordinary skill in the art based on various design criteria. For example, a large cavity taper angle improves the weight distribution characteristics of the Interlocking, interchangeable Support Base System 100. However, a large cavity taper angle also increases the manufacturing complexity of both the hub 120 and the leg 140. Thus, a person of ordinary skill in the art should aim to balance the need for improved weight distribution properties with the need for simplified manufacturing, as well as other factors, when selecting the cavity taper angle that produces the desired change in cross-sectional area. In various embodiments, the cavity taper angle is at least about 1 degree, between about 5 degrees and about 60 degrees, or between about 10 degrees and about 30 degrees. In other embodiments, particularly those in which the cavity 134 has a non-uniform change in cross-sectional area, the cross-sectional area of the lower portion 130 of the cavity 134 is at least about 5 percent, between about 10 percent and about 100 percent, or between about 15 percent and about 50 percent larger than the cross-sectional area of the upper portion 132 of the cavity 134. Due to the shape of the cavity 134, the leg 140 can only be inserted into the channel 126 by sliding the leg 140 up from the bottom of the hub 120. Thus, the tapered shape of the cavity 134 prevents the leg 140 from being inserted into the cavity 134 in the upside-down position because the smaller cross-sectional area of the upper portion 132 will not accommodate the part of the leg 140 that is sized to fit into the larger cross-sectional area of the lower portion 130, as will be described in more detail herein.

Figure 2:
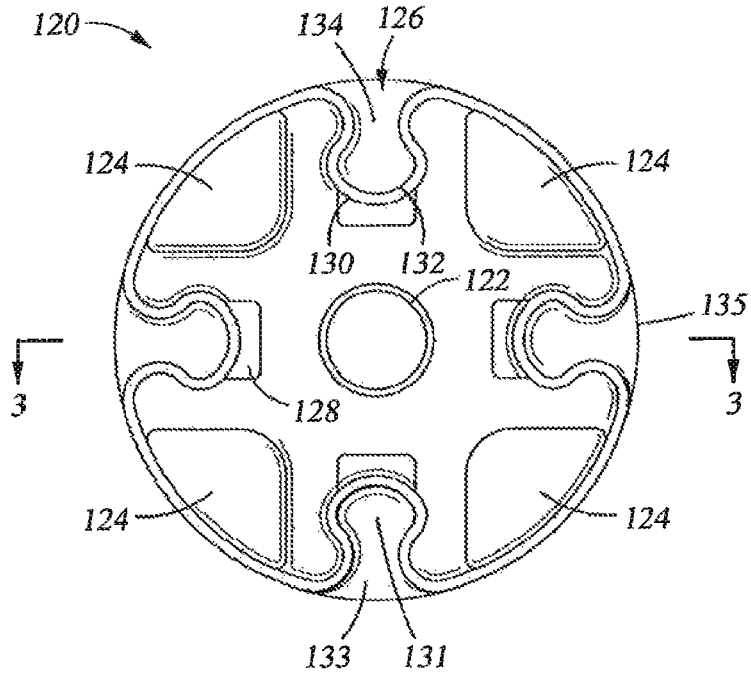
FIG. 2 is a bottom plan view of one embodiment of a hub of the Interlocking, Interchangeable Support Base System.
Figure 15:
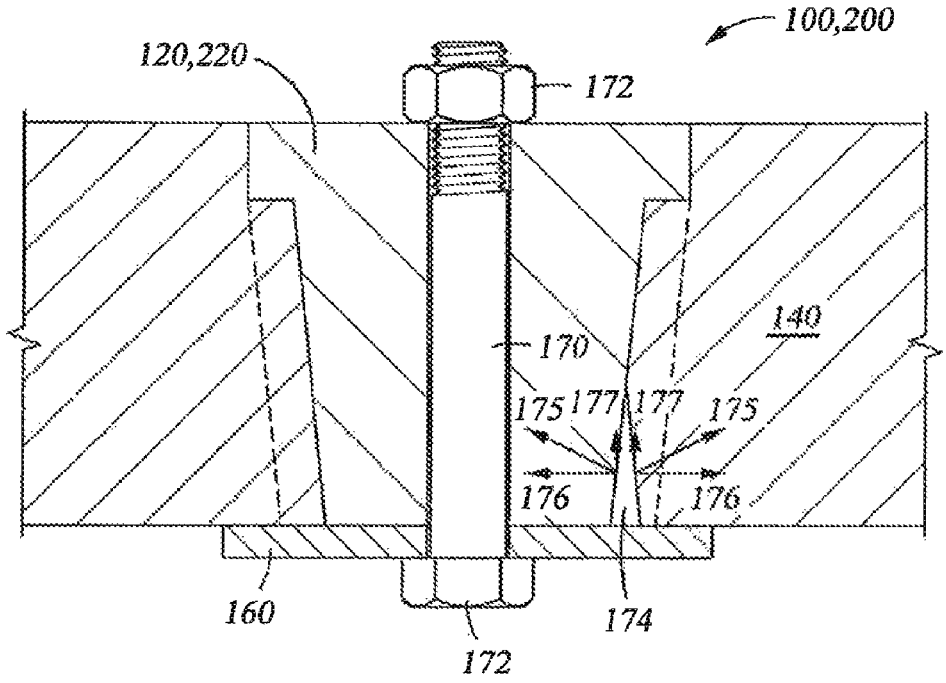
FIG. 15 is a cross-sectional side view of an alternative embodiment of the assembled Interlocking, Interchangeable Support Base System.

As best shown in FIG. 2, the cavity 134 may also be neck-shaped such that the inner portion 131 of the channel 126 closest to the bolt hole 122 has a larger width than the outer portion 133 of the channel 126 adjacent the side surface 135 of the hub 120. In addition, and as explained in further detail below, the interaction between the cavity 134 and the leg 140 improves the weight distribution between the hub 120 and the leg 140, thereby increasing the structural integrity of the Interlocking, Interchangeable Support Base System 100. As will also be explained in greater detail below, if the hub 120 is configured with the optional key recess 128, the hub key recess 128 works with a key recess 153 on the leg 140 to define a keyhole that is sized to receive a key 174 as shown in FIG. 15. The key 174 creates a multi-dimensional force 175 between the hub 120 and the leg 140 that tightens the connection therebetween.

Of course, a person of ordinary skill in the art will appreciate that the Interlocking, Interchangeable Support Base System 100 includes embodiments of the hub 120 not specifically illustrated or described herein. For example, the hub 120 can be shaped in alternative shapes, such as oval, elliptical, triangular, square, rectangular, or any other polygonal shape. The hub 120 can be configured with one, two, three, four, five, six, or any other number of channels 126. Similarly, the hub 120 can be configured with zero, one, two, three, four, five, or six guides 124, Further in the alternative, the channel 126 can be open to the top, bottom, inside, or outside of the hub 120.

Figure 5A:
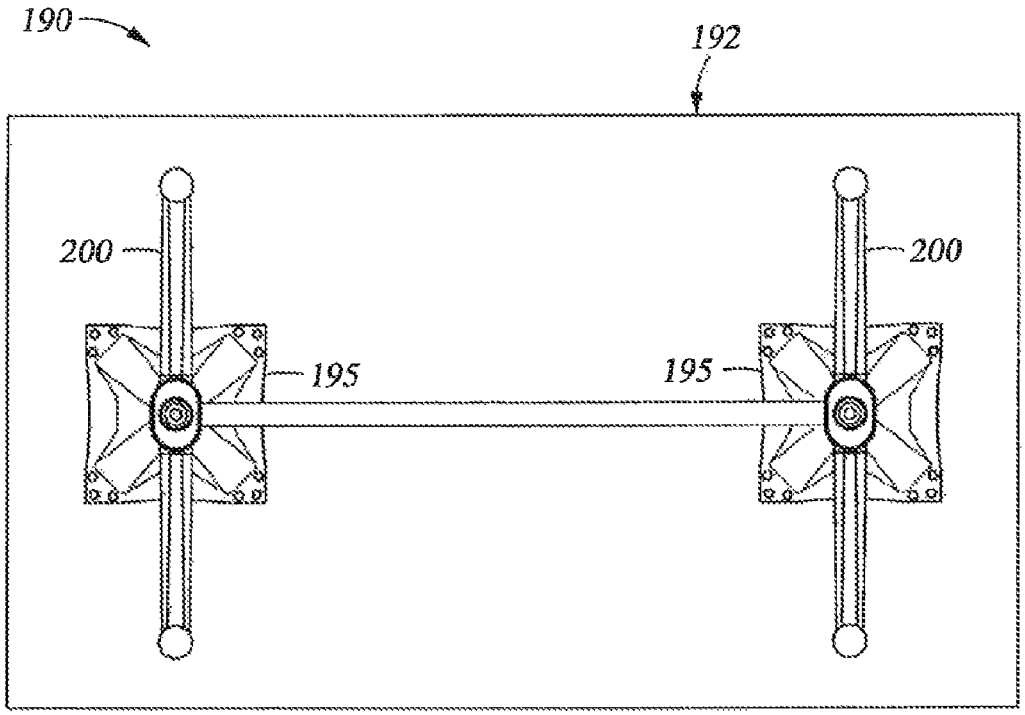
FIG. 5A is a top plan view of an alternative embodiment of an assembled Interlocking, Interchangeable Support Base System in a representative operational environment forming part of a rectangular table.
Figure 5B:
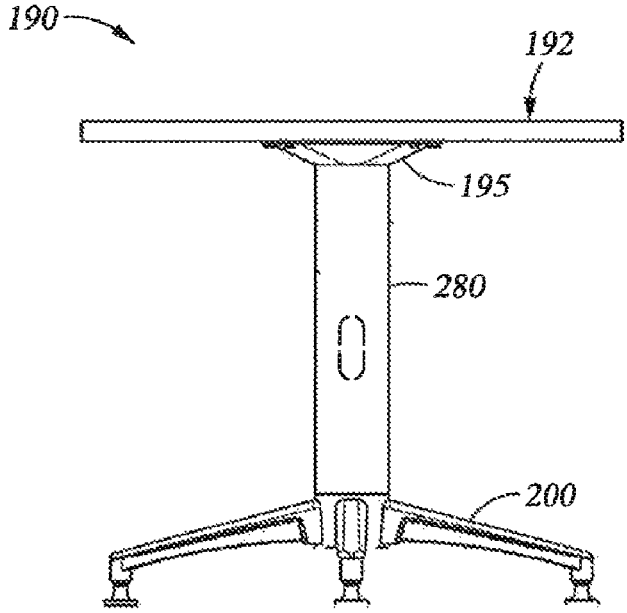
FIG. 5B is an end elevational view of the rectangular table comprising the alternative embodiment of the assembled Interlocking, Interchangeable Support Base System depicted in FIG. 5A.
Figure 5C:
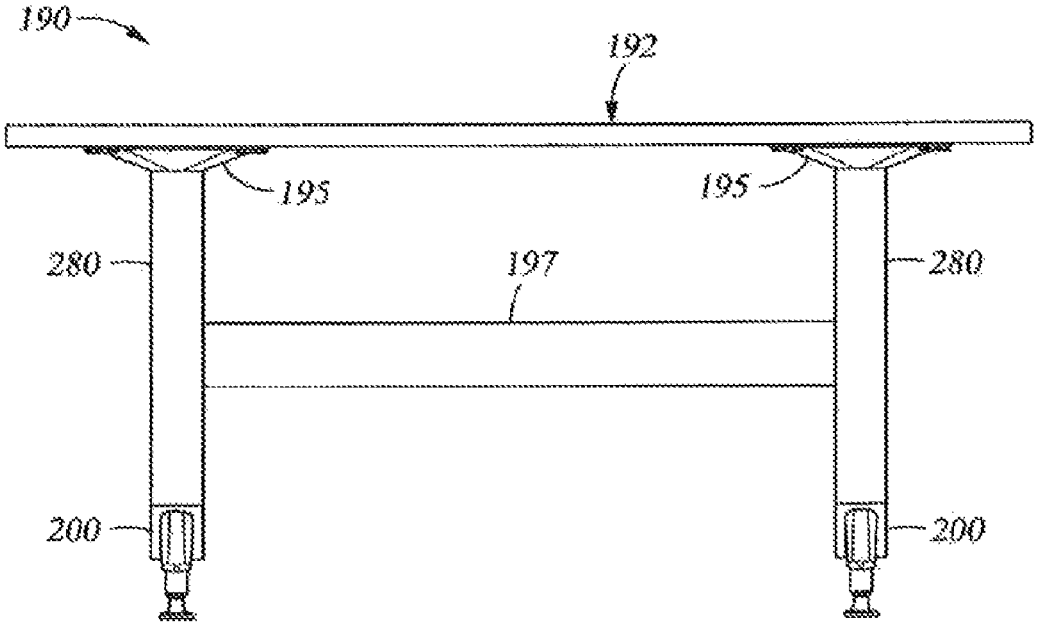
FIG. 5C is a side elevational view of the rectangular table comprising the alternative embodiment of the assembled Interlocking, Interchangeable Support Base System depicted in FIG. 5A.
Figure 6:
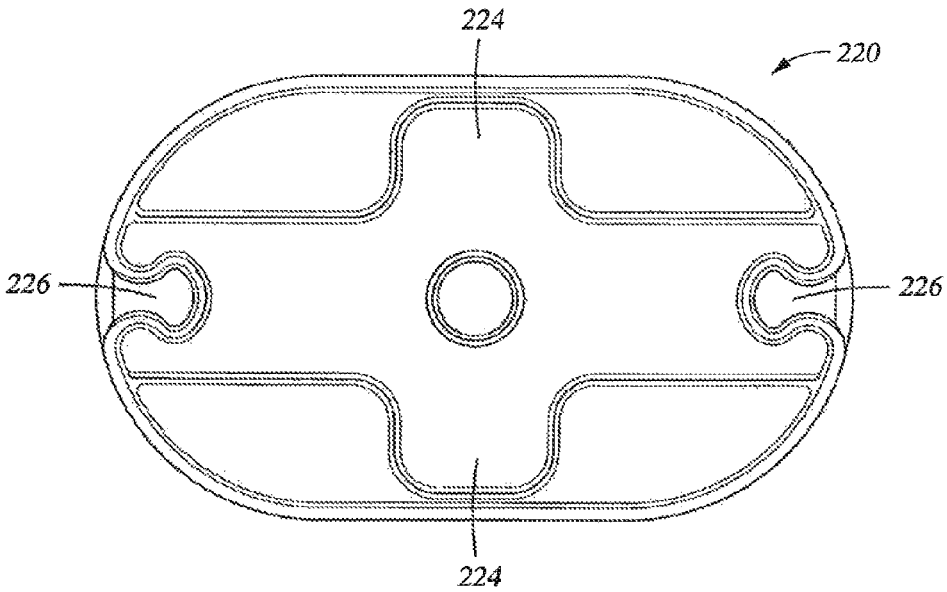
FIG. 6 is a bottom plan view of an alternative embodiment of the hub of the Interlocking, Interchangeable Support Base System.
Figure 7A:
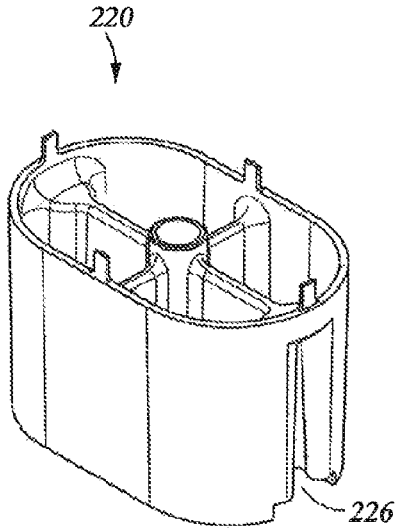
FIG. 7A is a top perspective view of the hub illustrated in FIG. 6.
Figure 7B:
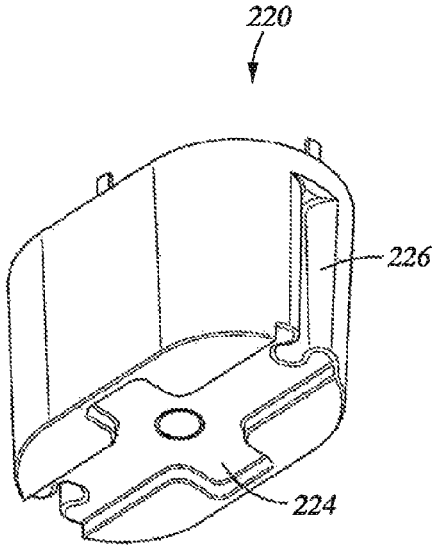
FIG. 7B is a bottom perspective view of the hub illustrated in FIG. 6.
Figure 11A:
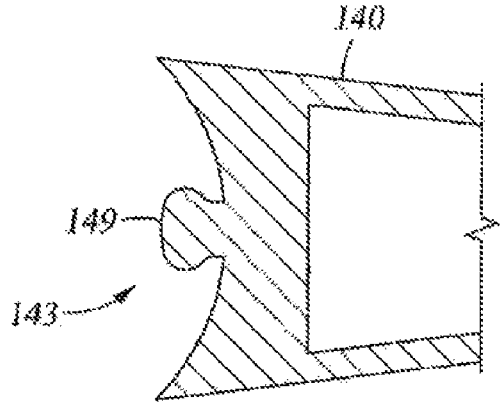
FIG. 11A is a cross-sectional top view of a finger extending from an end of the table leg, taken along section line 11A-11A in FIG. 8.
Figure 11B:
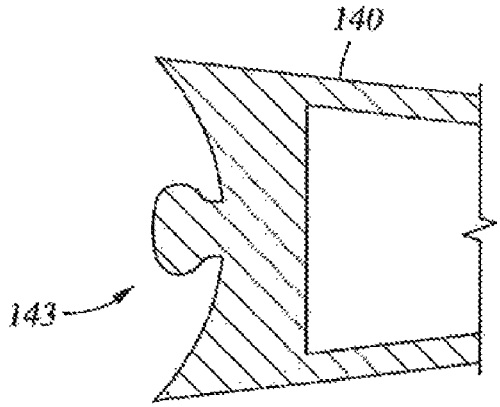
FIG. 11B is a cross-sectional top view of a finger taken along section line 11B-11B in FIG. 8.
Figure 11C:
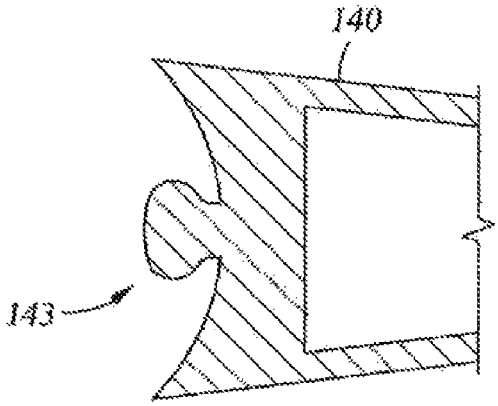
FIG. 11C is a cross-sectional top view of the finger taken along section line 11C-11C in FIG. 8.
Figure 11D:
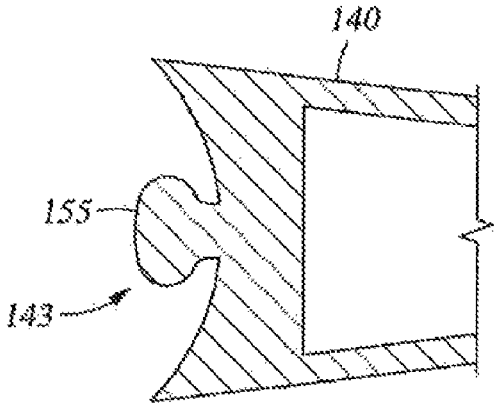
FIG. 11D is a cross-sectional top view of the finger taken along section line 11D-11D in FIG. 8.

FIGS. 5A, 5B, and 5C illustrate an alternative design for a rectangular table 190, which incorporates an alternative embodiment of the Interlocking, Interchangeable Support Base System 200. The rectangular table 190 illustrated in FIGS. 5A, 5B and 5C is similar to the round table 90 illustrated in FIGS. 1A and 1B, with the exception that the rectangular table 190 in FIGS. 5A, 5B, and 5C contains two brackets 195, two support poles 280, two Interlocking, Interchangeable Support Base Systems 200, and a cross-support 197. FIGS. 6, 7A, and 7B illustrate an alternative embodiment of a hub 220 comprising two channels 226 and two guides 224. While the alternative hub 220 illustrated in FIGS. 6, 7A, and 7B may be used as the sole support for an article of furniture, a plurality of the hubs 220 illustrated in FIGS. 6, 7A, and 7B may be used to support different areas of an article of furniture, such as the rectangular table 190 shown in FIGS. 5A, 5B, and 5C.

Another component of the Interlocking, Interchangeable Support Base System 100, 200 is the leg 140. In the embodiment illustrated in FIGS. 8, 9, and 10, the leg 140 comprises three sections: a shoulder 142, a shall 144, and a foot 146. The shoulder 142 connects the leg 140 to the hub 120, 220 and comprises a finger 143, an optional collar 151, an optional pocket 145, and an optional key recess 153. The finger 143 is approximately the same size as the cavity 134 and slides into the channel 126, 226 from the bottom of the hub 120, 220. The finger 143 necks down where it connects to the remainder of the leg 140 such that the outermost portion 141 of the finger 143 is thicker than the innermost portion 148 of the finger 143 as shown in FIG. 9. The necked down innermost portion 148 of the finger 143 allows the hub 120, 220 to retain the finger 143 within the channel 126, 226 when the finger 143 is inserted into the channel 126, 226.

In an embodiment, the finger 143 may be tapered such that the cross-sectional area of the top 149 of the finger 143 is smaller than the cross-sectional area of the bottom 155 of the finger 143. FIGS. 11A, 11B, 11C, and 11D illustrate various cross-sectional top down views of the finger 143, taken along section lines 11A-11A, 11B-11B, 11C-11C, and 11D-11D of FIG. 8, respectively. FIGS. 11A, 11B, 11C, and 11D clearly illustrate that the cross-sectional area of the finger 143 is increasing from the top 149 of the finger 143 shown in FIG. 11A to the bottom 155 of the finger 143 shown in FIG. 11D. While it is envisioned that the change in cross-sectional area may not be uniform over the vertical length 157 of the finger 143, as identified in FIG. 10, in an embodiment, the change in cross-sectional area results from a finger taper angle that produces a uniform change in cross-sectional area across the vertical length 157 of the finger 143. The finger taper angle may be defined as the angle between a true vertical axis and the wall of the finger 143. Numerous finger taper angles are suitable for the purposes described herein, and the specific finger taper angle should be selected by a person of ordinary skill in the art based on various design criteria. For example, a large finger taper angle improves the weight distribution characteristics of the Interlocking, Interchangeable Support Base System 100, 200. However, a large finger taper angle also increases the manufacturing complexity of both the hub 120, 220 and the leg 140. Thus, a person of ordinary skill in the art should aim to balance the need for improved weight distribution properties with the need for simplified manufacturing, as well as other factors, when selecting the finger taper angle that produces the desired change in cross-sectional area. In various embodiments, the finger taper angle is at least about 1 degree, between about 5 degrees and about 60 degrees, or between about 10 degrees and about 30 degrees. In other embodiments, particularly those in which the finger 143 has a non-uniform change in cross-sectional area, the cross-sectional area of the bottom 155 of the finger 143 is at least about 5 percent, between about 10 percent and about 100 percent, or between about 15 percent and about 50 percent larger than the cross-sectional area of the top 149 of the finger 143. The tapered shape of the finger 143 prevents the finger 143 from being inserted into the cavity 134 in the upside-down configuration. In addition, the tapered shape of the finger 143 allows for better weight distribution between the hub 120, 220 and the legs 140. More specifically, the tapered finger 143 and channel 126, 226 allow the weight of the article of furniture to be transferred from the hub 120, 220 to the leg 140 across the top and side surfaces of the finger 143. In contrast, if the finger 143 were shaped such that it was not tapered (e.g. the walls of the finger 143 were vertical), then the load would merely be transferred from the hub 120, 220 to the leg 140 across the top surface of the finger 143, not the combination of the top and side surfaces of the finger 143.

The improved weight distribution characteristics of the interlocking, Interchangeable Support Base System 100, 200 allow less structural material to be used in the various components of the Interlocking, Interchangeable Support Base System 100, 200, and also allow the Interlocking, Interchangeable Support Base System 100, 200 to support larger loads than untapered designs to meet structural integrity standards common within the furniture industry. For example, a finite elements analysis (FEA) indicates that the Interlocking, Interchangeable Support Base System 100, 200 would meet American National Standards Institute (ANSI)/Business and Institutional Furniture Manufacturer's Association (BIFMA) standard X5.5-1998, section 4.

Referring again to FIGS. 8, 9 and 10, in an embodiment, the shoulder 142 further comprises a collar 151 which is a decorative component that wraps around part of the hub 120, 220. The collar 151 is sized such that radius of curvature of the collar 151 is approximately equal to the radius of curvature of the hub 120, 220. Thus, when the leg 140 is attached to the hub 120, 220 the collar 151 conforms to the hub 120, 220 to reduce the visibility of the connection between the hub 120, 220 and the leg 140, thereby giving the appearance that the hub 120, 220 and the leg 140 are of unitary construction.

In an embodiment, the shoulder 142 further comprises a pocket 145, which is a downwardly tapered portion of the shoulder 142 that mates with the washer 160. When the bolt 170 is tightened to secure the various components of the Interlocking, Interchangeable Support Base System 100, 200 together, the washer 160 mates with the pocket 145 and exerts the multi-dimensional force 175 shown in FIG. 14 on the leg 140, the force 174 acting to tighten the connection between the leg 140 and the hub 120, 220. While it is envisioned that the pocket taper may not be uniform over the horizontal width 159 of the pocket 145, as identified in FIG. 8, in an embodiment the taper results from a pocket taper angle that produces a uniform taper across the horizontal width 159 of the pocket 145. The pocket taper angle may be defined as the angle between a true horizontal axis and the surface of the pocket 145. Numerous pocket taper angles are suitable for the purposes described herein and the specific pocket taper angle should be selected by a person of ordinary skill in the art based on various design criteria. For example, a large pocket taper angle increases a horizontal component 176 of the multi-dimensional force 175, thereby improving the ability of the washer 160 to tighten the connection between the hub 120, 220 and the leg 140. However, a large pocket taper angle also decreases a vertical component 177 of the multi-dimensional force 175, limiting the ability of the washer 160 to retain the legs 140 in the hub 120, 220. Thus, a person of ordinary skill in the art should aim to balance the need for the horizontal component 176 with the need for the vertical component 177 of the multi-dimensional force 175, as well as other factors, when selecting the pocket taper angle. In one embodiment, the pocket taper angle is substantially the same as the washer taper angle discussed below. In various embodiments, the pocket taper angle is at least about 1 degree, between about 5 degrees and about 60 degrees, or between about 30 degrees and about 45 degrees.

In an embodiment, the shoulder 142 further comprises the key recess 153 depicted in FIG. 10. The key recess 153, in combination with the key recess 128 on the hub 120, 220 defines a keyhole sized to receive the key 174 shown in FIG. 15. The key 174 can be angled such that the key 174 exerts the multi-dimensional force 175 on the hub 120, 220 and the leg 140, which tightens the connection of the leg 140 to the hub 120, 220.

Referring again to FIGS. 8, 9 and 10, the leg 140 also comprises the shaft 144 and the foot 146. The shaft 144 connects the shoulder 142 to the foot 146 and extends away from the hub 120, 220 in at least the horizontal direction such that the Interlocking, Interchangeable Support Base System 100, 200 has a wider footprint and thus greater stability. As shown in phantom lines in FIGS. 8 and 9, the shaft 144 optionally comprises a plurality of ribs 147 for increasing the structural integrity of the shaft 144. The foot 146 is the section of the leg 140 that ultimately supports the Interlocking, Interchangeable Support Base System 100 and may comprise a hole 169. If desired, a leveling foot, wheel, or caster (not shown) may be inserted into the hole 169 so that the article of furniture can be leveled or made to roll across a floor or other surface.

Figure 12:
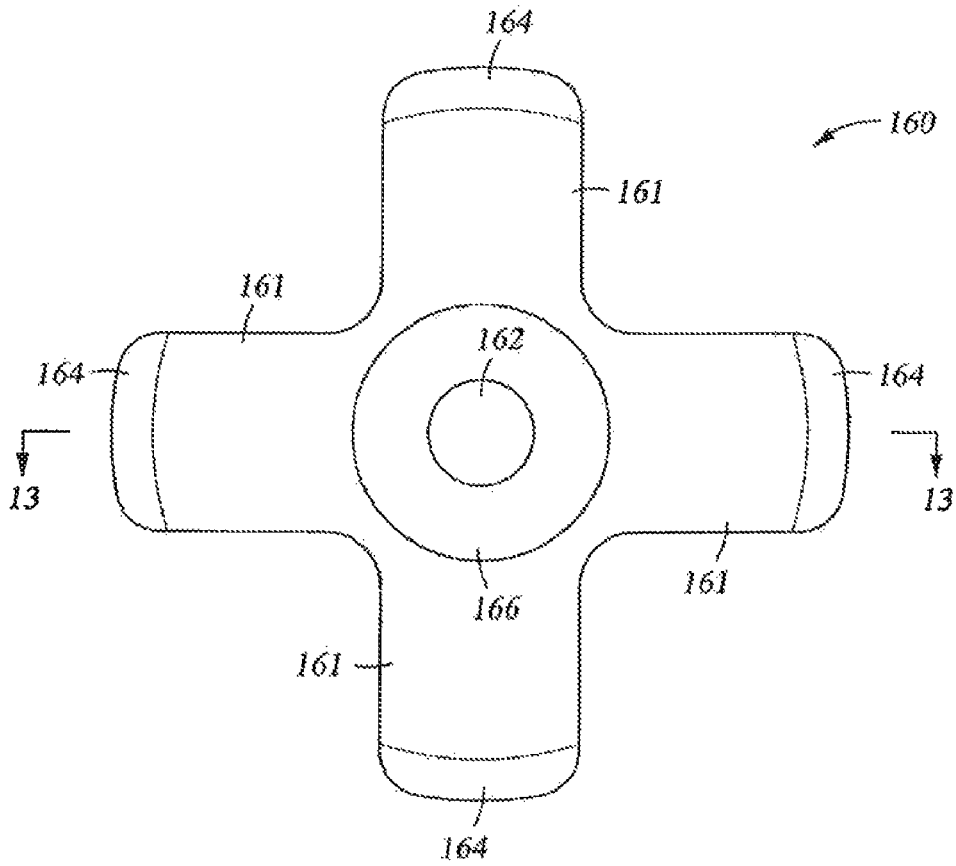
FIG. 12 is a top plan view of one embodiment of a washer of the interlocking, Interchangeable Support Base System.
Figure 13:
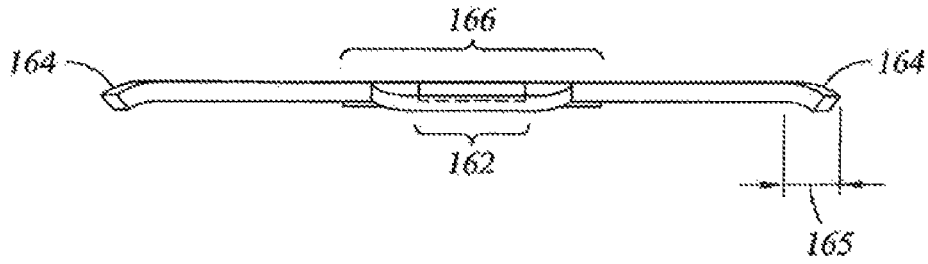
FIG. 13 is a cross-sectional side view of the washer, taken along section line 13-13 in FIG. 12.
Figure 14:
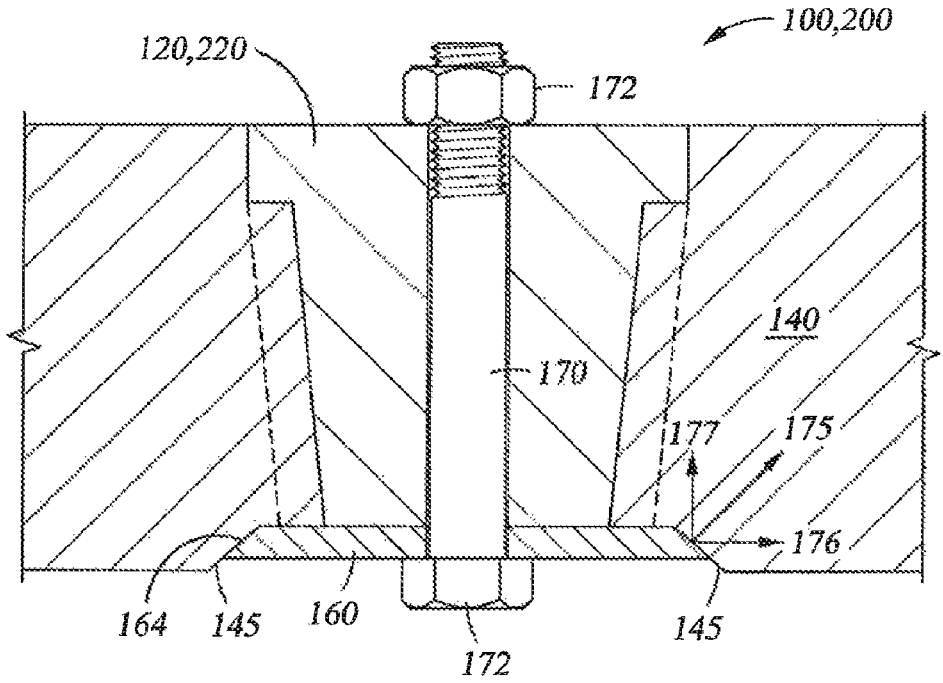
FIG. 14 is a cross-sectional side view of an embodiment of the assembled Interlocking, interchangeable Support Base System.

Referring now to FIGS. 12 and 13, another component of the Interlocking, Interchangeable Support Base System 100, 200 is the washer 160, which is shaped to conform to the lower surface of the hub 120, 220. More specifically, the washer 160 comprises a plurality of arms 161, a plurality of optional tapered ends 164, a hole 162, and an optional depression 166. The arms 161 fit between the guides 124, 224 on the lower side of the hub 120, 220 and may position the tapered ends 164 in the pockets 145. In particular, the tapered ends 164 mate with the pockets 145 and, upon tightening the bolt 170, exert the multi-dimensional force 175 upon the pockets 145 as shown in FIG. 14. While it is envisioned that the taper may not be uniform over the horizontal length 165 of the tapered end 164, in an embodiment the taper results from a washer taper angle that produces a uniform taper across the horizontal length 165 of the tapered end 164. The washer taper angle may be defined as the angle between a true horizontal axis and the upper surface of the tapered end 164. Numerous washer taper angles are suitable for the purposes described herein and the specific washer taper angle should be selected by a person of ordinary skill in the art based on various design criteria. For example, a large washer taper angle increases the horizontal component 176 of the multi-dimensional force 175, thereby improving the ability of the washer 160 to tighten the connection between the hub 120, 220 and the leg 140. However, a large washer taper angle also decreases the vertical component 177 of the multi-dimensional force 175, limiting the ability of the washer 160 to retain the legs 140 in the hub 120, 220. Thus, a person of ordinary skill in the art should aim to balance the need for the horizontal component 176 with the need for the vertical component 177 of the multi-dimensional force 175, as well as other factors, when selecting the washer taper angle. In one embodiment, the washer taper angle is substantially the same as the pocket taper angle discussed above. In various embodiments, the washer taper angle is at least about 1 degree, between about 5 degrees and about 60 degrees, or between about 30 degrees and about 45 degrees. Referring again to FIGS. 12 and 13, the hole 162 in the washer 160 allows the bolt 170 to pass through the washer 160. The washer 160 may also be configured with a depression 166 adjacent to the hole 162. The depression 166 allows the bolt 170 to be separated from the remainder of the surface of the washer 160, thereby accommodating larger bolt heads and allowing the assembly tools to have better gripping capacity on bolt heads having a low profile. Of course, in alternative embodiments the washer 160 may contain any number of arms 161 and/or may comprise a conventional round disc or other polygonal shape. Furthermore, in certain embodiments of the Interlocking, Interchangeable Support Base System 100, 200 such as the embodiment shown in FIG. 15, the washer 160 can be configured without the tapered ends 164.

As described above, the Interlocking, Interchangeable Support Base System 100, 200 is assembled by sliding the legs 140 upwardly into the channels 126, 226 of the hub 120, 220, positioning the washer 160 under the hub 120, 220, sliding the bolt 170 through the washer 160 and hub 120, 220, and tightening the nut 172 on the bolt 170. FIGS. 14 and 15 illustrate the assembled connection between the hub 120, 220, the leg 140, the washer 160, the bolt 170, and the nut 172.

More specifically, FIG. 14 illustrates the embodiment of the Interlocking, Interchangeable Support Base System 100, 200 in which the washer 160 contains the tapered end 164 and the leg 140 contains the pocket 145. As shown in FIG. 14, the washer 160 exerts a multi-dimensional force 175 comprising a vertical component 177 and a horizontal component 176 on the leg 140. The vertical component 177 retains the leg 140 within the hub 120, 220 while the horizontal component 176 pushes the leg 140 outwardly away from the hub 120, 220. The outward force on the leg 140 caused by the horizontal component 176 tightens the connection between the hub 120, 220 and the leg 140 such that the position of the leg 140 is substantially fixed with respect to the hub 120, 220 and thus the article of furniture. The fixed position of the leg 140 with respect to the hub 120, 220 substantially eliminates any wiggle in the connection between the leg 140 and the hub 120, 220, which is important because any wiggle would be very apparent to the users of the article of furniture, particularly in tables.

Turning now to FIG. 15, an alternative embodiment of the Interlocking, Interchangeable Support Base System 100, 200 is illustrated. Unlike the embodiment illustrated in FIG. 14, the embodiment illustrated in FIG. 15 lacks the tapered ends 164 on the washer 160 and the pocket 145 in the leg 140, and instead uses a key 174 to create the multi-dimensional force 175. More specifically, when the bolt 170 is tightened, the washer 160 exerts an upward force on the key 174, which in turn causes the key 174 to exert the multi-dimensional force 175 on the hub 120, 220 and/or the leg 140. Depending on the shape of the key 174, the key 174 may exert the multi-dimensional force 175 on the hub 120, 220 on the leg 140, or on both the hub 120, 220 and the leg 140. As with the embodiment illustrated in FIG. 14, the embodiment illustrated in FIG. 15 comprises the vertical component 177 of the multi-dimensional force 175 that retains the leg 140 within the hub 120, 220 as well as the horizontal component 176 of the force 175 that pushes the leg 140 outwardly away from the hub 120, 220. The outward force on the leg 140 caused by the horizontal component 176 tightens the connection between the hub 120, 220 and the leg 140 such that the position of the leg 140 is substantially fixed with respect to the hub 120, 220 and thus the article of furniture. Of course, persons of ordinary skill in the art will appreciate that the key 174 and the combination of the tapered ends 164 and the pocket 145 perform similar functions. Thus, the Interlocking, Interchangeable Support Base System 100, 200 can be configured with the key 174, the combination of the tapered ends 164 and the pocket 145, or the key 174 and the combination of the tapered ends 164 and the pocket 145.

The Interlocking, Interchangeable Support Base System 100, 200 may be used as a support base system for any type of furniture. For example, the Interlocking, Interchangeable Support Base System 100, 200 can be used as a support base system for commercial or residential furniture such as chairs, stools, tables, desks, and various types of stands, for example. It is also contemplated that the interlocking, Interchangeable Support Base System 100, 200 can be used as a support base system for other items not specifically described herein.

The various components illustrated and discussed herein can be made of any type of suitable material and produced by any acceptable method. For example, the various components may be made of wood, metal, plastic, other materials, or combinations thereof. The various components may be made by milling, casting, forging, extrusion, any other manufacturing method, or combinations thereof. In one embodiment, the various components of the Interlocking, Interchangeable Support Base System 100, 200 are made from aluminum or steel in a die casting process. One method for die casting aluminum components is described in U.S. Pat. No. 7,772,821 to Fulton et al., entitled "System for Manufacturing Die Castings," which is incorporated by reference herein as if reproduced in its entirety. In various embodiments, the cast components may be chrome plated, brushed, or have a powder-coated finish.

While various embodiments of Interlocking, Interchangeable Support Base Systems and associated methods have been shown and described herein, modifications thereof may be made by one skilled in the art without departing from the spirit and the teachings of the disclosure. The embodiments described herein are exemplary only and are not intended to be limiting. Many variations, combinations, and modifications are possible and are within the scope of the disclosure. Accordingly, the scope of protection is not limited by the description set out above, but is defined by the claims which follow, that scope including all equivalents of the subject matter of the claims.

What is claimed is:

1. A support system comprising:

a hub comprising an axially extending channel with a key recess at a lower end thereof;

a leg comprising an axially extending finger that slideably engages the channel and a key recess disposed below the finger;

a washer that engages the hub and prevents the finger from disengaging the channel;

a key disposed in a keyhole formed by aligning the key recesses in the hub and the leg; and a means for connecting the hub and the washer;

wherein when the hub and the washer are connected, a multi-dimensional force is exerted that tightens the connection between the hub and the leg.

2. The support system of claim 1 wherein the multi-dimensional force is exerted by the key on the leg, on the hub, or on both.

3. The support system of claim 1 further comprising a collar disposed on the leg and conforming to the shape of the hub to reduce the visibility of the connection between the hub and the leg, and wherein the hub further comprises a guide that aligns the at least one arm of the washer with respect to the channel.

4. The support system of claim 1 wherein the finger is shaped to prevent the leg from engaging the channel in an upside-down position.

5. The support system of claim 4 wherein the finger is tapered such that the cross-sectional area of the top of the finger is different than the cross-sectional area of the bottom of the finger.

6. The support system of claim 5 wherein the channel is tapered to correspond with and matingly engage the tapered finger.

7. The support system of claim 1 wherein the key comprises an angled surface between about 5 degrees and about 60 degrees.

8. A method of connecting a support system for an article of furniture comprising:

inserting a finger of a leg into a channel of a hub to form a mating connection therebetween;

connecting a washer to the hub to maintain the finger within the channel; and exerting a multi-dimensional force to secure the leg to the hub; wherein the washer comprises a tapered surface and the leg comprises a tapered surface, the method further comprising:

mating the tapered surface of the washer to the tapered surface of the leg; and tightening the connection between the hub and the washer, such that the washer creates the multi-dimensional force.

9. The method of claim 8 wherein the tapered surface of the washer has an angle between about 30 degrees and about 45 degrees.

10. The method of claim 8 further comprising inserting a bolt through the washer and the hub, thereby connecting the hub, the washer, and the leg together; wherein the bolt connects the hub to a support pole for the article of furniture.

11. A method of connecting a support system for an article of furniture comprising:

inserting a finger of a leg into a channel of a hub to form a mating connection therebetween;

connecting a washer to the hub to maintain the finger within the channel; and exerting a multi-dimensional force to secure the leg to the hub; wherein the finger of the leg comprises a key recess and the hub further comprises a key recess, such that a keyhole is formed by aligning the key recesses of the finger and the hub, the method further comprising inserting a key into the keyhole between the hub and the leg to create the multi-dimensional force.

12. The method of claim 11 wherein connecting the washer to the hub creates an upward force on the key to create the multi-dimensional force.

13. The method of claim 12 wherein the key comprises an angled surface.

14. The method of claim 13 further comprising inserting a bolt through the washer and the hub, thereby connecting the hub and the washer together; wherein the bolt connects the hub to a support pole for the article of furniture.

15. A support system comprising:

a hub comprising a channel;

a leg comprising a finger that slideably engages the channel; and a washer comprising at least one arm that engages the hub and that prevents the finger from disengaging the channel; and a means for connecting the hub and the washer;

wherein when the hub and the washer are connected, a multi-dimensional force is exerted that tightens the connection between the hub and the leg, the support system further comprising a key disposed between the hub and the leg, wherein:

the key comprises an angled surface;

the hub further comprises a key recess at a lower end thereof;

the leg further comprises a key recess, such that aligning the key recesses in the hub and the leg forms a keyhole for retaining the key; and connecting the washer to the hub creates an upward force on the angled surface of the key, such that the key exerts the multi-dimensional force.

16. A support system comprising:

a hub comprising a channel;

a leg comprising a finger that slideably engages the channel; and a washer comprising at least one arm that engages the hub and that prevents the finger from disengaging the channel; and a means for connecting the hub and the washer;

wherein when the hub and the washer are connected, a multi-dimensional force is exerted that tightens the connection between the hub and the leg; wherein the leg further comprises a pocket forming a tapered surface, the washer comprises a tapered end, and the washer mates with the pocket to create the multi-dimensional force.

17. The support system of claim 16 wherein the pocket taper angle is between about 30 degrees and about 60 degrees.

18. The support system of claim 16 wherein the hub comprises a plurality of channels and a plurality of guides arranged in alternating configuration equidistant around the perimeter of the hub, and the washer comprises a plurality of arms that engage the hub, such that the washer is shaped to conform to the lower surface of the hub.

* * * * *